US006015069A

United States Patent [19]

Christensen

[11] Patent Number: 6,015,069

[45] Date of Patent: Jan. 18, 2000

[54] GARMENT FOLDING TABLE

[76] Inventor: Larry Alan Christensen, 103 St. Croix Ct., Aurora, Ill. 60504

[21] Appl. No.: 09/075,640

[22] Filed: May 11, 1998

[51] Int. Cl.[7] ..... A41H 33/00

[52] U.S. Cl. ..... 223/37; 493/405

[58] Field of Search ..... 223/37, 30; 493/405, 493/411, 413, 452

[56] References Cited

U.S. PATENT DOCUMENTS

| | | | |
|---|---|---|---|
| 1,657,551 | 1/1928 | Schremp | 223/37 |
| 1,852,604 | 4/1932 | Canfield | 223/71 |
| 2,855,649 | 10/1958 | Kowter | 223/87 |
| 4,421,500 | 12/1983 | Smith | 493/405 |
| 5,011,052 | 4/1991 | Craig | 223/37 |
| 5,137,190 | 8/1992 | Plaud | 223/38 |
| 5,154,329 | 10/1992 | Dorfmueller | 223/37 |
| 5,308,051 | 5/1994 | Spitzmesser | 270/45 |
| 5,417,641 | 5/1995 | Warren | 493/405 |

FOREIGN PATENT DOCUMENTS

| | | | |
|---|---|---|---|
| 1076507 | 2/1984 | U.S.S.R. | 223/37 |

*Primary Examiner*—Bibhu Mohanty
*Attorney, Agent, or Firm*—John C. Albrecht

[57] ABSTRACT

A hand operated garment folding table for processing knit upper garments comprises an adjustable width bed and a pair of fixed arms. Offset hinges couple the arms to the bed.

2 Claims, 1 Drawing Sheet

GARMENT FOLDING TABLE

TECHNICAL FIELD

Preparation of "soft" upper garments, e.g., knit T shirts, sport shirts, sweaters, etc., for display in open stacks or in shelving display units.

BACKGROUND OF THE INVENTION

"Soft" upper garments generally are made of knitted material. Between the time that new stocks of "soft" upper garments reach a retail outlet and the time of sale, there is a need to not only fold each item for display; but to also refold substantial numbers of items which have been examined by potential customers. Such "soft" garments generally reach a retail store unfolded and laying flat in a shipping box. Although it is possible to display soft goods on hangers, it is generally accepted that display of folded garments in open stacks or in shelving units is more economical in floor space required for display; and is more attractive than hanger presentation. Since, in retail stores, any available employee is called to this duty, there is great variation in the appearance of folded garments. Variation in appearance of folded items detracts from the "sale's appeal" of goods; and may tend to reduce the volume of sales. Since no employee is expected to be an expert in manually folding garments, considerable employee time, both in and out of normal store hours, may be spent in folding garments.

DISCLOSURE OF THE INVENTION

In accordance with the present invention, my FOLD-PRO™ garment folding table comprises a flat bed and a pair of hinged folding arms for receiving a garment to be folded. In one embodiment of my invention, the bed is adjustable in width to accommodate folded garments to different shelf widths. In a second embodiment of my invention, the size of the bed is fixed in dimension so as to fold a garment to a desired width. In both embodiments, the lengths of the bed and the two arms are equal and fixed.

In accordance with an aspect of my invention, the arms are coupled to the bed by "offset" hinges which provide a desired gap, e.g., one quarter inch, between the surfaces of the bed and of an arm when the arm is fully rotated over the bed. In accordance with another aspect of my invention, the sum of the widths of the two arms is greater than the width of the bed.

Advantageously, garments folded with my table have uniform dimensions and appearance.

THE DRAWING

DETAILED DESCRIPTION

Figure 1:
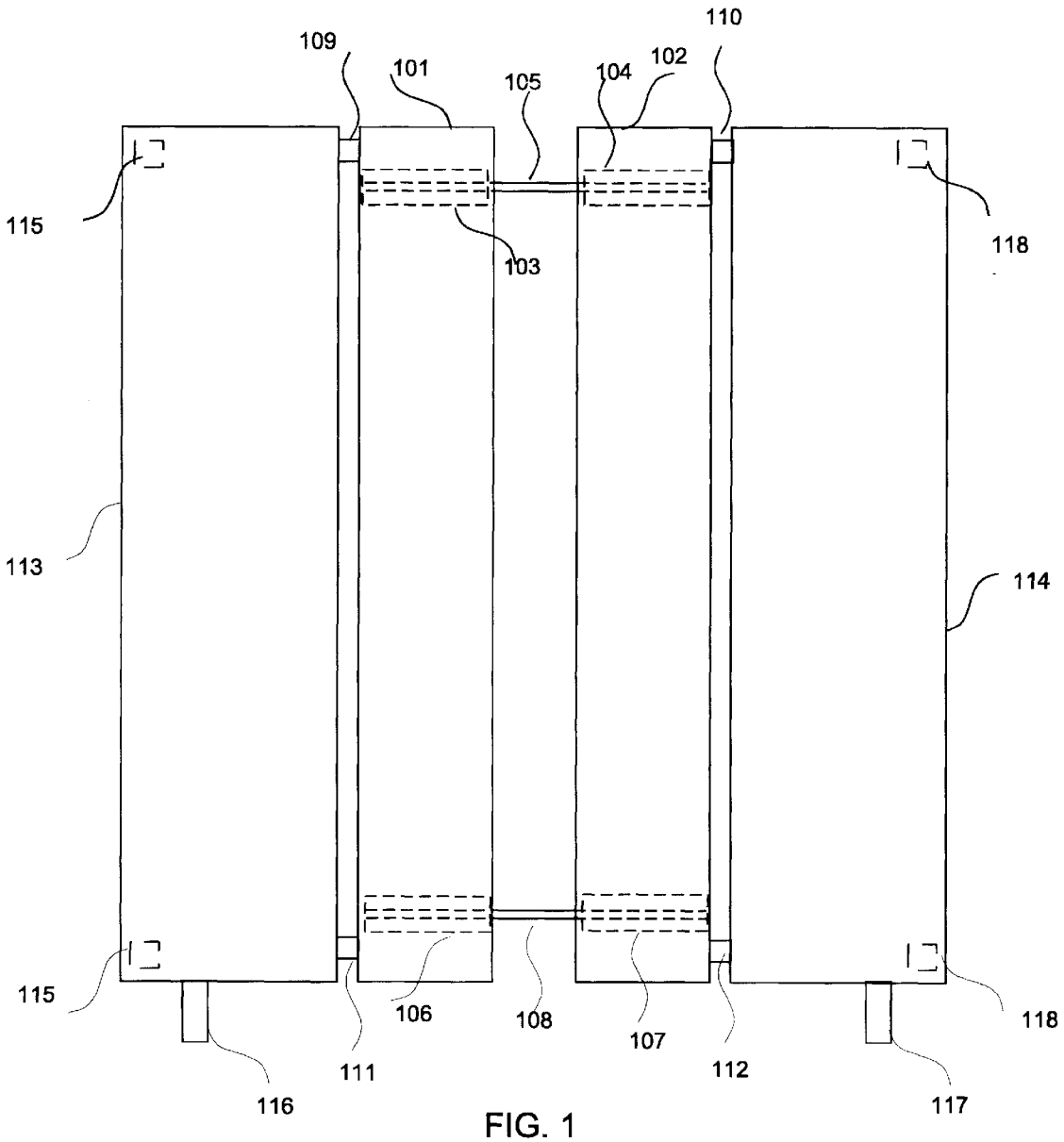
FIG. 1 is a top view of my adjustable folding table.
Figure 2:
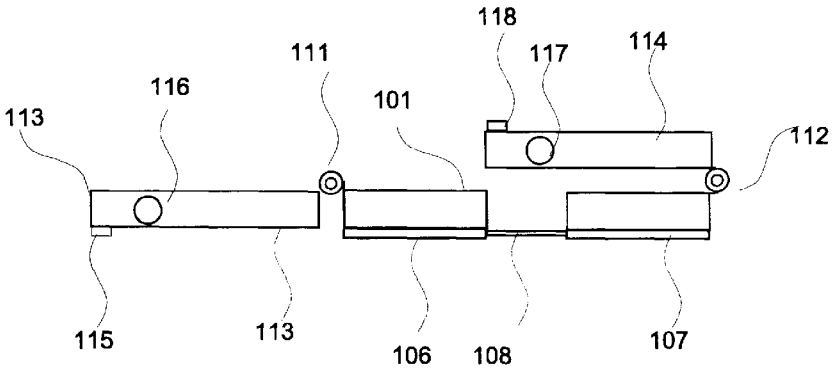
FIG. 2 is a modified edge view of the table of FIG. 1.

The figures of FIGS. 1 and 2 are representative of the relations of the components; however they are not necessarily of exact scale. The folding table of FIGS. 1 and 2 comprises an adjustable bed 101, 102,103, 104, 105, 106, 107, 108 and a pair of arms 113, 114. Each arm is rotatably attached to the adjacent side of the bed by an "off-set" hinge assembly. For example right arm 114 is attached to section 102 by the hinges 110, 112. Similarly, left arm 113 is attached to section 101 by hinges 109, 111. The arms are aligned with the bed and spaced apart therefrom by a fixed distance.

The hinge arrangements in FIGS. 1 and 2 are merely illustrative of a possible hinge arrangements. For example, a different number of independent hinges may be used, or a continuous piano hinge may be used.

The function of the offset hinges is demonstrated in FIG. 2. FIG. 2 is edge view of the table of Fig. modified to show arm 114 rotated 180 degrees counter clock wise. The "off-set" hinges provide a desired gap, e.g., one quarter inch, between the surfaces of the bed and of an arm when the arm is fully rotated over the bed.

Hinge offset is accomplished by placing the centers of rotations of hinges 109, 110, 111, and 112 above the surfaces of the bed members 101, 102; and of the arms 113, 114. It is possible to fold knit upper garments in the absence of the gap; however provision of a gap between arm 114 and bed member 102, as illustrated in FIG. 2, better controls the dimensions of the folded garments.

As seen in both FIG. 1 and in FIG. 2, the sum of the widths of the two arms is greater than the width of the bed.

Handles 116 and 117 permit an operator to easily rotate the respective arms 113 and 114.

Solely for the purpose of illustration, two slide assemblies are illustrated in FIG. 1. One assembly comprises the blocks 103, 104 and a slide bar 105. The other slide assembly comprises blocks 106, 107, and slide bar 108. Pads 115 on the underside of arm 113 compensate for the thickness of blocks 103, 106. Similarly, pads 118 on the underside of arm 114, compensate for the thickness of blocks 104, 107.

In preparation for use, my FOLD-PRO™ table is placed on a stable, flat surface and the width of the bed is adjusted. The adjusted width of the bed defines the width of the folded article. Adjustment of the bed width thus permits garments to be folded to a range of desired widths.

A knit upper garment to be folded is placed front face down, centered left to right over the table, and with the collar alligned with upper edge of the bed. If the length of the article is greater than the length of the bed, the operator turns the waist portion of the garment up so as to lie fully over the bed 101, 102 and the arms 113, 114. The operator also folds the garment arms inwardly. Folding is accomplished by first rotating one arm, e.g., the left arm 113 clockwise over the bed; returning arm 113 to the position shown in FIGS. 1 and 2. Thereafter, rotating the right arm 114 counter clockwise over the bed to its position as illustrated in FIG. 2. Upon return of arm 114 to its original position as shown in FIG. 1, the operator folds the bottom edge of the garment to the top edge of the bed. Folding is the complete and the garment may be turned with the front facing the operator and removed.

FIGS. 1 and 2 illustrate one illustrative embodiment of my invention with an adjustable bed. An economy version may comprise a bed of fixed width to replace the illustrated adjustable bed.

The invention has been described with particular attention to its preferred embodiment; however, it should be understood that variations and modifications within the spirit and scope of the invention may occur to those skilled in the art to which the invention pertains.

What is claimed is:

1. A manual garment folding table comprising:

a rectangular bed having a length and a width, a rectangular left folding arm having a length equal to the length of said bed and a fixed width, offset hinge means attached to one long edge of said left arm and to one long edge of said bed, a rectangular right folding arm having a length equal to the length of said bed and a fixed width, and offset hinge means attached to one long edge of said right arm and to the other long edge of said bed, said offset hinge means constructed to provide a gap of a planned width between the opposing surfaces of said bed and of an arm when said arm is fully rotated over said bed.

2. A manual garment folding table in accordance with claim 1 wherein:

the width of said bed is adjustable, and the sum of the widths of said left and right arms is greater than the maximum width of the bed.

* * * * *